US006042048A

United States Patent [19]

Czuprynski et al.

[11] Patent Number: 6,042,048

[45] Date of Patent: Mar. 28, 2000

[54] CORE FOR WINDING A WEB OF DEFORMABLE MATERIAL

[75] Inventors: Daniel Martin Czuprynski, Fairport; Zbigniew Hakiel, Webster; Allan Thomas Hoy, Clarkson, all of N.Y.

[73] Assignee: Eastman Kodak Company, Rochester, N.Y.

[21] Appl. No.: 09/132,436

[22] Filed: Aug. 11, 1998

Related U.S. Application Data

[62] Division of application No. 08/844,190, Apr. 18, 1997, which is a continuation of application No. 08/484,421, Jun. 7, 1995, abandoned.

[51] Int. Cl.[7] ..... B65H 75/08

[52] U.S. Cl. ..... 242/613; 242/610.4; 242/610.6; 242/609.1; 242/609.3; 264/259; 264/294; 264/493; 264/496

[58] Field of Search ..... 242/609, 609.1, 242/609.2, 609.3, 609.4, 610.4, 610.6, 613, 613.5; 264/178 R, 211.16, 232, 259, 294, 296, 340, 464, 477, 492, 493, 494, 496

[56] References Cited

U.S. PATENT DOCUMENTS

| | | |
|---|---|---|
| 801,576 | 10/1905 | Elixman et al. . |
| 1,222,943 | 4/1917 | Gammeter . |
| 1,619,371 | 3/1927 | Rogers et al. . |
| 1,927,673 | 9/1933 | Allen . |
| 2,094,008 | 9/1937 | Freedlander . |
| 2,985,398 | 5/1961 | Rockstrom et al. . |
| 3,145,451 | 8/1964 | Christensen . |
| 3,236,431 | 2/1966 | Foreman . |
| 3,642,223 | 2/1972 | Feichtinger . |
| 3,713,601 | 1/1973 | Buhrman et al. . |
| 3,737,030 | 6/1973 | Stewart . |
| 3,883,293 | 5/1975 | McCarroll . |
| 3,893,795 | 7/1975 | Nauta . |
| 4,198,008 | 4/1980 | Krautwald . |
| 4,594,068 | 6/1986 | Bardutzky et al. . |
| 4,695,008 | 9/1987 | Dabrowski . |
| 4,934,622 | 6/1990 | Hakiel . |
| 5,109,587 | 5/1992 | Kusch . |
| 5,195,430 | 3/1993 | Rise . |
| 5,229,813 | 7/1993 | Cherian . |
| 5,381,984 | 1/1995 | Hindsgual . |
| 5,393,010 | 2/1995 | Renck . |
| 5,441,780 | 8/1995 | Bushell et al. . |
| 5,469,619 | 11/1995 | Renck . |
| 5,535,961 | 7/1996 | Duckworth et al. . |

FOREIGN PATENT DOCUMENTS

| | | |
|---|---|---|
| 499981 | 8/1992 | European Pat. Off. . |
| 2329568 | 5/1977 | France . |
| 2832361 | 1/1980 | Germany . |
| 3610557 | 6/1994 | Germany . |

*Primary Examiner*—Donald P. Walsh
*Assistant Examiner*—William A. Rivera
*Attorney, Agent, or Firm*—Susan L. Parulski

[57] ABSTRACT

A core winding a web of deformable material which is thicker along its margins, particularly knurl-edged webs. The core includes a rigid cylindrical member and a deformable cover supported by the rigid member. First and second detachable end members are adapted for attachment to the ends of the rigid member. The hardness of the end members is harder than the deformable cover such that the knurled margins overlay the end members.

2 Claims, 4 Drawing Sheets

CORE FOR WINDING A WEB OF DEFORMABLE MATERIAL

CROSS-REFERENCE TO RELATED APPLICATION

This is a Divisional of U.S. patent application Ser. No. 08/844,190 filed Apr. 18, 1997, which is a Continuation of U.S. patent application Ser. No. 08/484,421 filed Jun. 7, 1995, now abandoned.

FIELD OF THE INVENTION

The invention relates to cores for winding webs of deformable material. More particularly, the invention relates to cores for winding webs, particularly, webs having edge portions which are thicker than a center portion, for example, knurl-edged webs.

BACKGROUND OF THE INVENTION

As described in published German Patent Application No. 3,610,557, a known problem in winding webs of paper onto a rigid core is that the adhesive tape used to secure the leading edge of the web to the core will cause an embossing of the paper for many turns of the web on the core. This embossing occurs by virtue of the finite thickness of the adhesive tape, and the high radial pressure which builds up as successive turns are wound on the core. The leading edge of the web also causes such embossings. Web containing such embossings is generally useless and has to be discarded.

As described in published German Patent Application No. 3,610,557, a solution to the problem is to provide the core with a coating of elastically or plastically deformable material which deforms to accommodate the irregularity. As such, the web of the first turns on the core does not deform to accommodate the irregularity.

When manufacturing webs, particularly webs of base material for photographic film, problems arise from the lack of uniformity in thickness (often referred to as "gage") across the web. One such problem arising from gage non-uniformity is known as gage bands. Gage bands occur, for example, when a region of increased thickness is at a lateral constant position. Then, as the web is wound on a core, the increased thickness regions of each turn will lie on top of the increased region of the previous turn. With gage bands, very high localized pressure often results in undesirable effects, such as abrasions, deformations, chemical changes, and physical changes. A known solution to gage bands is to make the margins thicker, or to knurl the margins of the web so that the protuberances produced by the knurling are higher than any gage increase likely to be encountered during normal manufacturing. Thus, when the web with the knuris along its two margins is wound on a conventional rigid core (with a nondeformable surface), the knurls in the margins wind on top of themselves. It is in these areas, rather than where the gage increases overlap one another, that the areas of high pressure are encountered. During manufacture, the margins containing the knurls are slit off and discarded, while the entire portion of the web between the knurls is assumed to be free from defects attributable to gage bands.

It has been noted that when a web having knurled margins is wound onto a deformable core, such as described in published German Patent Application No. 3,610,557, if the deformable coating is soft enough to avoid undesirable embossings caused by the securing tape or leading edge, the very high pressures progressively created by the overlapping knurls cause the wound web to collapse radially inwards. Such collapses are not localized, and extend along the roll axially from the edges of the web toward the middle of the width of the roll. Permanent damage to the web occurs from the collapse, requiring an increased width of the web at the margins to be slit off and discarded, resulting in undesirable increased waste and correspondingly lower productivity.

U.S. Pat. No. 4,934,622, assigned to same assignee, incorporated herein by reference, describes a means for avoiding embossing and collapse of the wound roll. A first resilient sleeve is supported on a rigid member. A second and third sleeve, harder than the first sleeve, are positioned contiguous with the ends of the first sleeve, and are intended to underlie the margins of the web.

While the above-identified apparatuses has achieved a certain degree of success, impressions can be created from the sharp transitions between the sleeves, and one particular core cannot accommodate webs of varying widths. For example, if a narrower web were wound onto the core, the knurls would be positioned over the first sleeve, causing the roll to collapse. Alternately, if a wider web were wound onto the core, the impression from the sharp transition would occur within the non-knurled, (i.e., saleable) portion of the web.

The present invention provides a modular design, thereby assisting in the reduction of manufacturing costs by allowing the modular components to be recycled or readily replaced. Further, a gradual transition zone allows a particular core size to accommodate webs of varying widths.

Accordingly, a need exists for a core for winding a web of deformable material which accommodates various web widths, is not complex, can be manufactured inexpensively, affords modularity, avoids embossing, and is able to avoid collapse.

SUMMARY OF THE INVENTION

An object of the invention is to provide a core which avoids embossing in the turns of a web wound on a core, the web having thicker edges (for example, knurls in its margins), and avoids the collapse of the wound web, particularly axially inward from the thicker edges of the web.

Another object of the invention is to provide a core which is able to accommodate various widths of web material, is not complex, and can be manufactured inexpensively.

A further object of the invention is to provide a core which is recyclable or modular.

These objects are given only by way of illustrative examples; thus, other desirable objectives and advantages inherently achieved by the disclosed invention may occur or become apparent to those skilled in the art. The invention is defined by the appended claims.

According to one aspect of the invention, there is provided a core for winding a web of deformable material which is thicker along its margins. The core includes a rigid cylindrical member extending from a first end to a second end. A deformable cover having an outer diameter is supported by the rigid member throughout the length of the deformable cover. A first detachable cylindrical end member is attached to the rigid member at the first end, while a second detachable cylindrical end member is attached to the rigid member at the second end. The end members abut the rigid member and cover. The first and second end members have an outer diameter approximately equal to the outer diameter of the deformable cover and a hardness greater than the hardness of the deformable cover, such that the margins of the web overlay the first and second end members.

According to another aspect of the invention, the core includes a rigid cylindrical member extending from a first end to a second end. A deformable cover having a first hardness and an outer diameter extends from the first end to the second end and is supported by the rigid member. The portions of the cover supported at the first and second ends are treated by a process to provide a hardness harder than the hardness of the remaining portion of the cover, such that the margins of the web overlay the harder ends of the cover.

According to a further aspect of the invention, the core includes a rigid member having a first and second end and a first, second and center portion. The first portion is located at one end of the rigid member, while the second portion is located at the other end. The center portion being positioned intermediate the first and second portions. The center portion is cylindrical and has a first diameter. Each of the first and second ends including a taper providing cylindrical surfaces having a diameter greater than the first diameter. A deformable cover having an outer diameter extends from the first end to the second end and is supported by the rigid member, such that the margins of the web overlay the first and second ends of the rigid member.

The core of the present invention avoids embossing and collapse, is able to accommodate webs of varying widths, and has fewer components, thus reducing the complexity and cost. In addition, the core is modular, such that each component can be recycled, or readily replaced if damaged.

BRIEF DESCRIPTION OF THE DRAWINGS

The foregoing and other objects, features, and advantages of the invention will be apparent from the following more particular description of the preferred embodiments of the invention, as illustrated in the accompanying drawings.

DETAILED DESCRIPTION OF THE INVENTION

Figure 1:
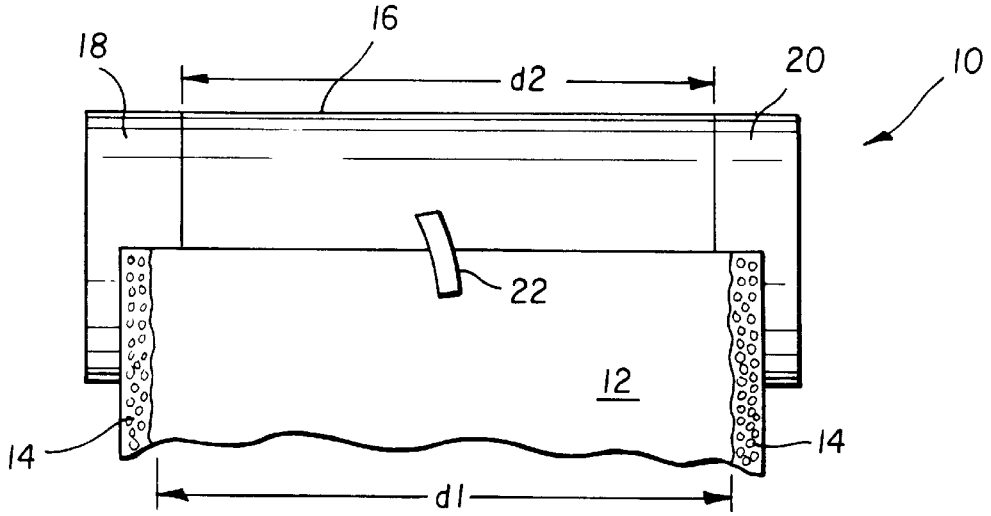
FIG. 1 is a view of a core with the leading edge of a web secured thereto at the beginning of winding the web onto the core.

The following is a detailed description of the preferred embodiments of the invention, reference being made to the drawings in which the same reference numerals identify the same elements of structure in each of the several figures.

FIG. 1 illustrates a core 10 for winding a web 12 of a flexible deformable material, for example, cellulose triacetate photographic film base. Web 12 has knurls 14 in its margins which, in effect, increase the maximum thickness of web 12. A distance d1 between the margins containing knurls 14 is shown, and is generally uniform throughout the length of web 12. Core 10 includes a central member 16 having a length d2, and two end members, hereinafter referred to as first end member 18 and second end member 20. Securing means 22 are provided, such as a piece of adhesive tape, to secure the leading edge of web 12 to core 10. The tape piece 22 has a finite thickness, as does web 12. Therefore, when web 12 overlaps tape piece 22 at the beginning of the second turn, and steps up over the leading edge of the web, the effective diameter of the web tends to take a sharp increase. If core 10 is not deformable, the sharp effective diameter increase would cause embossings into the second, and successive, turns of the web as it is wound and as the pressure increases with each successive turn.

Figure 2:
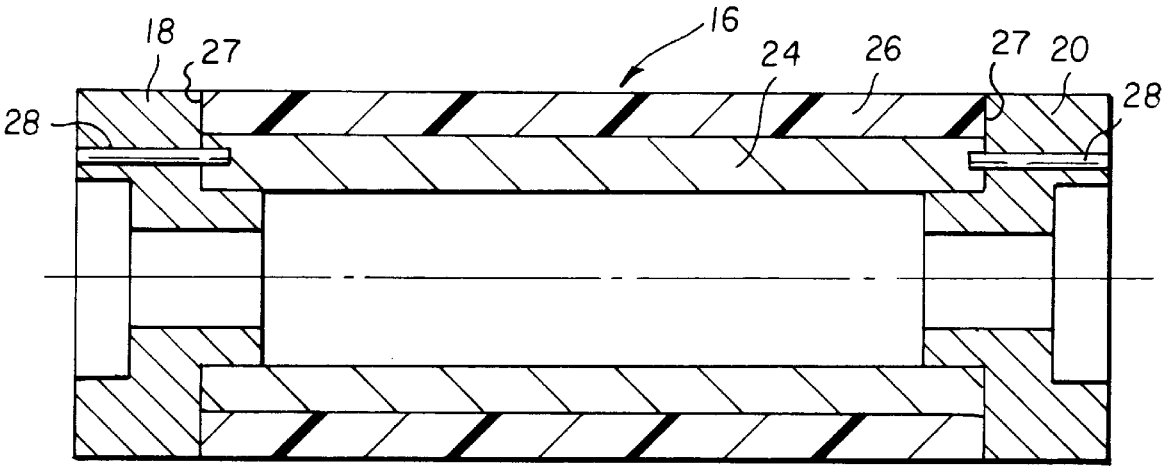
FIG. 2 is a sectional view in a plane containing the axis, of a core in accordance with a first embodiment of the present invention.

FIG. 2 illustrates a core of a first embodiment of the present invention. Central member 16 includes a rigid cylindrical member 24 having two ends. Rigid member 24 is generally formed of metal (such as stainless steel, carbon steel, or aluminum), phenolic, fiberglass reinforced resin, fiber reinforced plastic (such as polycarbonate), cardboard, or resin reinforced paper.

Rigid member 24 supports a deformable cover 26 having an outer diameter. Cover 26 is supported by rigid member 24 throughout the length of cover 26. Cover 26 may be bonded to rigid member 24 by vulcanizing or casting. Alternately, cover 26 may be a sheath which is slipped over rigid member 24 by techniques known to those skilled in the art, such as using pressurized air to slightly expand cover 26 for installation, thus allowing the cover to be detachable and/or replaceable. The cover may optionally be secured to rigid member 24, for example, by adhesive.

Cover 26 is preferably an elastomer material such as polyurethane, neoprene, nitrile rubber, or ethylene/propylene rubber. These elastomers may optionally be foamed. Other materials for cover 26 include plastic foams made up of ethylene ethyl acetate copolymer, polyethylene vinyl acetate copolymer, polystyrene, polyethylene, or polyvinyl chloride.

First and second end members 18,20 are configured to be matable with central member 16 such that end members 18,20 can be attached and detached from rigid member 24. First and second end members 18,20 include cylindrical surfaces having outer diameters substantially equal to that of the outer diameter of central member 16, and preferably are contiguous with central member 16 and coaxial with rigid member 24. End members 18, 20 each include an annular shoulder 27 which abuts the ends of rigid member 24 and the ends of cover 26. The knurled margins of web 12 are intended to overlay end members 18,20. For this purpose, the length d2 of central member 16 is less than or equal to the length d1. The actual length of first and second end members 18,20 and cover 26 depends on the accuracy with which web 12 is positioned laterally on core 10, and of course, on the width of web 12 and knurls 14. However, it is important that knurls 14 lie over first and second end members 18,20.

First and second end members 18,20 are harder than central member 16 to provide a higher stiffness to support the knurled margins of web 12. Central member 16 has, for example for cover 26 being made of an elastomeric material of approximately 0.3 inches thick, a 20 to 50 Shore A value, preferably 30 Shore A. First and second end members 18,20 may be made of a rigid material, such as steel, but elastomeric materials of approximately 0.3 inches thick with a 60 Shore A value, or materials with a 50–80 Shore D value have proven suitable.

Attachments means 28 secure end members 18,20 to rigid member 24, and allow end members 18,20 to be detached from rigid member 24. Attachment methods known to those skilled in the art include pinning or mating features such as notches or keys. In addition, adhesives, used either alone or in combination with pins, keys, or slots, can be used to secure end members 18,20 to rigid member 24. The application of heat or solvents will break the adhesive bond to allow detachment of sleeves 18,20. Such an embodiment provides a "modular" system; that is each component (i.e., central member 16, end members 18,20, or rigid member 24) can be readily replaced if damaged, or recycled.

Figure 3:
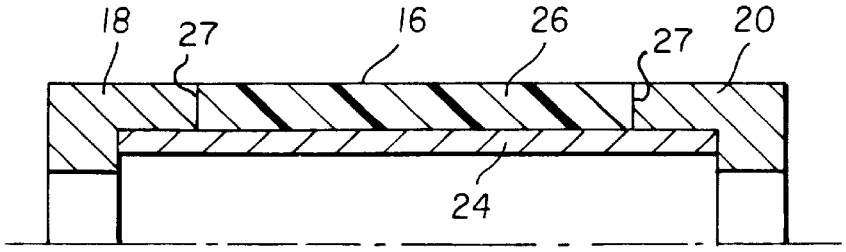
FIG. 3 is a sectional view of a core in a plane containing the axis, in accordance with the present invention.
Figure 4:
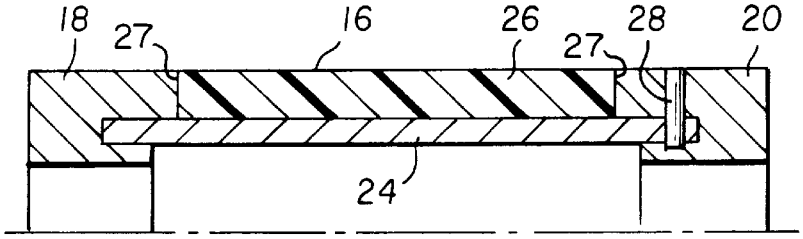
FIG. 4 is a sectional view of a core in a plane containing the axis, in accordance with the present invention.
Figure 5:
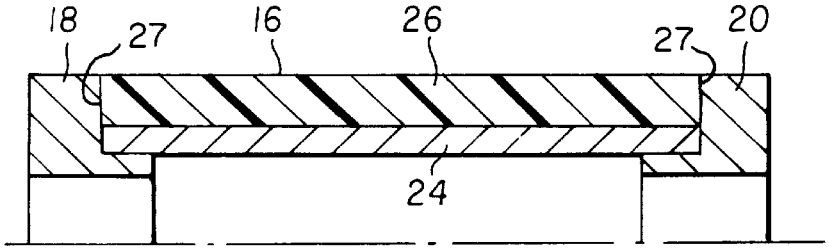
FIG. 5 is a sectional view of a core in a plane containing the axis, in accordance with the present invention.

Various configurations are possible for attaching end members 18,20 to central member 16. As illustrated in FIGS. 3–5, end members 18,20 are attachable to central member 16 by mating (for example, by pining or adhesive) with cover 26, rigid member 24, or both. FIGS. 3 and 4 show central member 16 wherein cover 26 extends over a portion of rigid member 24, while in FIG. 5 cover 26 extends over the entire length of rigid member 24.

Figure 6:
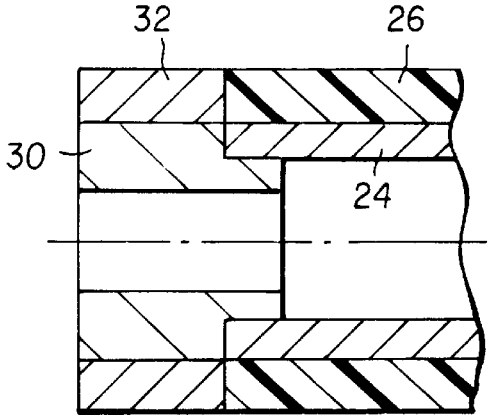
FIG. 6 is a sectional view of a core in a plane containing the axis, in accordance with the present invention.
Figure 7:
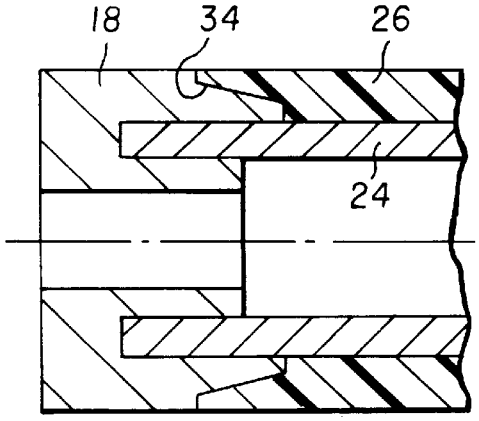
FIG. 7 is a sectional view of a core in accordance with the present invention.

First and second end members 18,20 may be made of a single material or, as illustrated in FIG. 6, they may comprise rigid member 30 having an outer cover 32. FIG. 7 illustrates a further configuration wherein cover 26 includes a taper or tapered counterbore 34 which flares outwardly from the outer diameter of rigid member 24. End members 18,20 include a corresponding tapered endportion so that cover 26 matably cooperates with end members 18,20. Such a tapered configuration may accommodate webs of varying widths since a gradual transition zone is provided between deformable cover 26 and hard end members 18,20, whereby the knurled-margins may be positioned over the thinner portion of deformable cover 26.

Figure 8:
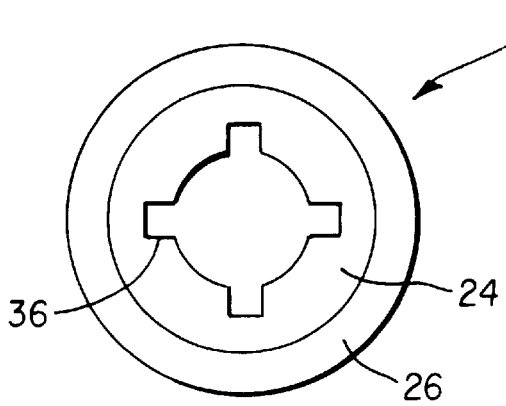
FIG. 8 is a side view of a core having keyways for coupling a core with drive means.

FIG. 8 shows an integrally formed keyway 36 for coupling core 10 with drive means (not shown) (e.g., drive spindle chucks), to wind or unwind web 12 from core 10.

The embodiment lends itself to low cost combinations since each component is replaceable. For example, a low cost central member can be recycled or discarded, yet the sleeves may be reused. Such a low cost central member may include member 24 made of cardboard, resin impregnated paper, or plastic. A low cost foam would be used for cover 26, such as polystyrene, polyurethane, polyethylene, polyvinyl chloride, ethylene ethyl acetate copolymer, and polyethylene vinyl acetate copolymer.

The greatest pressures in the roll are encountered in the margins where knurls 14 overlap one another in successive turns. The resulting pressures are so high in these regions that, if first and second end members 18,20 were as soft as central member 16, they would not be able to oppose collapse of the wound roll in some regions. (Such collapse is generally known as spoking or starring.) Thus, the hardness of sleeves 18,20 is chosen to be sufficient to prevent collapse. End members 18,20 should be formed of material from which the bulk viewpoint is an incompressible as possible, such as polyurethane. If it were compressible, there would be a progressive reduction in diameter of the core as the number of turns increased. Such a reduction in diameter would result in deformation of the web and a great length of the web would be useless.

Figure 9:
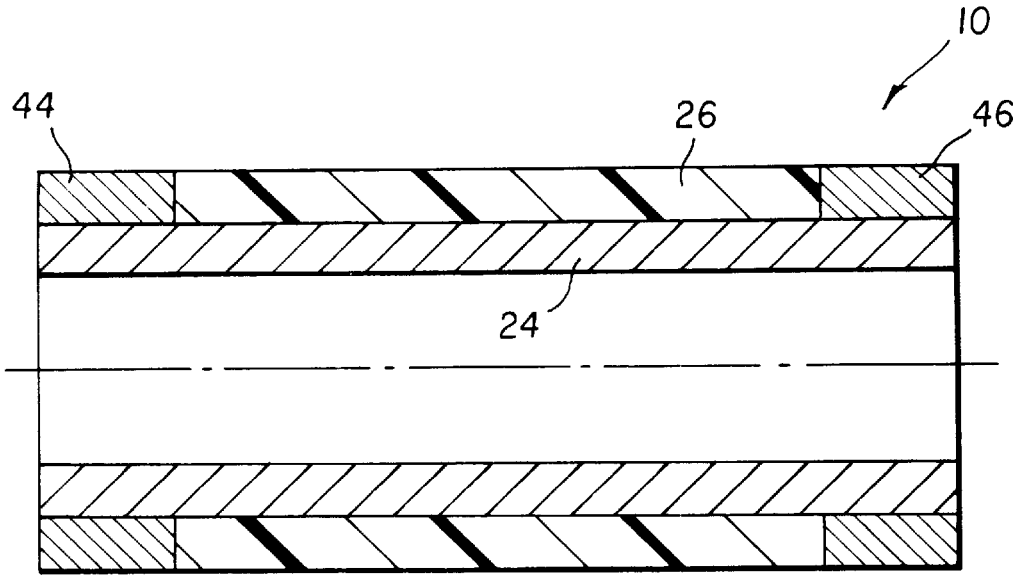
FIG. 9 is a sectional view in a plane containing the axis, of a core in accordance with a second embodiment of the present invention.

FIG. 9 shows a second embodiment wherein cover 26 of central member 16 and end members 18,20 are integral components. Rigid member 24 has two ends, and cover 26 extends along the length of rigid member 24 from one end to the other end. Ends 44,46 of cover 26 are treated by a process to selectively harden the surface. Such a process can include plating, coating, dipping, chemical reaction, or irradiation. The hardening process can be tailored (i.e., tapered, ramped or sloped) such that an abrupt soft-to-hard transition is avoided. For example, if a chemical reaction is used, core 10 can be immersed in a hardener, and gradually raised during the process to provide a gradual, programmable soft-to-hard transition. With gradual transitioning, webs of varying widths can be wound on one particular core size.

Such a core 10 can be formed by an extrusion process. If so extruded, the entire core of the first embodiment, including keyways, would consist of one part manufacturable in an inexpensive, continuous process, which could be then be cut to a desired length.

Figure 10:
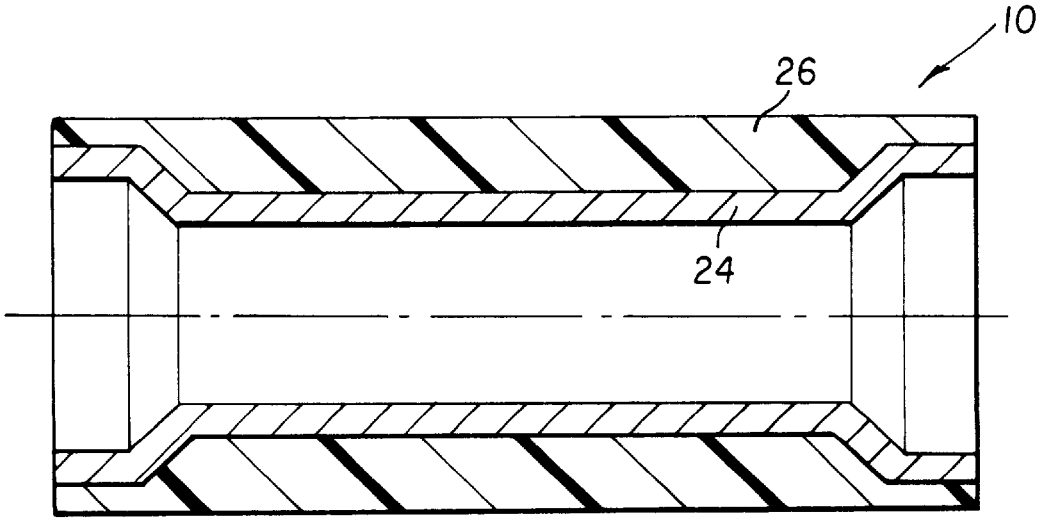
FIG. 10 is a sectional view in a plane containing the axis, of a core in accordance with a third embodiment of the present invention.

A third embodiment is illustrated in FIG. 10 where first and second end members 18,20 are integral with cover 26 and include a contoured or tapered member 24 layered by cover 26. The layer of cover 26 at the ends of rigid member 24 is thinner than in the center section, thereby providing the ends of core 10 with a reduced amount of deflection, and correspondingly, a higher hardness than the center section. The knurled margins are intended to overlay the less compressible ends of the core.

Figure 11:
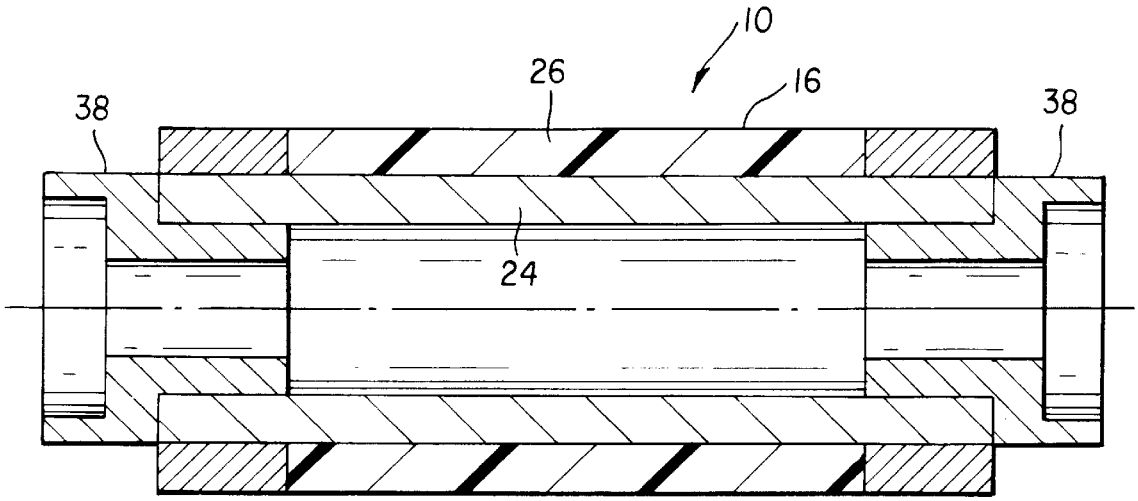
FIG. 11 is a sectional view in a plane containing the axis, of the core of FIG. 9 having end rings for coupling the core with drive means.
Figure 12:
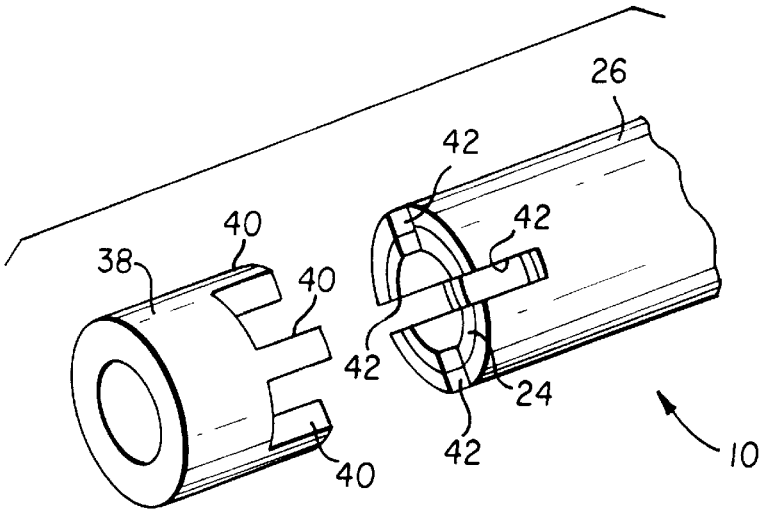
FIG. 12 is a isometric view of an end ring having integral keys matable with slots in a core.

The embodiments illustrated in FIGS. 9 and 10 may optionally include integral means for coupling core 10 with drive means. Or, as illustrated in FIG. 11, end rings 38 provide an alternate means for coupling core 10 with drive means. The outer diameter of end rings 38 may be any size. Referring to FIG. 12, end rings 38 may include integral keys 40 matable with slots 42 positioned within core 10 to secure the end rings to the core. Adhesives, either alone or combined with pins, keys, or slots, can be used to secure end rings 38 to core 10. Strong, durable materials are preferred for end rings 38, such as steel, aluminum, polycarbonate, or polyurethane. These coupling methods may apply to the embodiments illustrated in FIGS. 2 through 7 to attach end members 18,20 to rigid member 24.

U.S. Pat. No. 3,713,601, assigned to Buhrman and Hensley, describes means wherein end members 18,20 would be pressed into the inside diameter of rigid member 24, and include a plurality of circumferentially spaced and axially extending teeth which provide a positive non-slip connection for driving the core in any direction. A certain degree of success has been achieved using this method with rigid member 24 being made of paper or cardboard.

Those skilled in the art will recognize that particular dimensioning and material selection will be dependent on the application. For example, for applications wherein a core is intended to have limited use or a short life cycle, a core will be sized accordingly, and less expensive materials may be selected. For applications wherein a core is intended to have a long life cycle and be durable, dimensioning may include several factors of safety. Similarly, a core supporting a wound roll greater than 35 inches in diameter needs to be more durable than a core supporting a wound roll 5 inches in diameter.

For example, for a durable core of the kind illustrated in FIG. 2, rigid member 24 may be made of stainless steel of between 0.055 and 0.075 inches (1.4 and 1.9 mm), and cover 26 being a polyurethane between 0.225 and 0.375 inches (0.57 and 0.95 mm) and having a hardness between 20 and 50 Shore A, preferably 30 Shore A. End members 18,20 may be made of polyurethane with a hardness between 55 and 80 Shore D, preferably 75 Shore D. Pins and removable adhesive are used to attach end members 18,20 to center member 16.

For a durable core of the kind illustrated in FIG. 9, rigid member 24 may be made of stainless steel of between 0.055 and 0.075 inches (1.4 and 1.9 mm), and cover 26 being a polyurethane between 0.225 and 0.375 inches (0.57 and 0.95 mm) and having a hardness between 20 and 50 Shore A, preferably 30 Shore A. A preferred process to harden the ends of cover 26 is the process of chemical hardening or ultraviolet irradiation. U.S. Pat. No. 5,109,587 (Kusch), incorporated herein by reference, provides an example of such an ultraviolet irradiation process.

For a durable core of the kind illustrated in FIG. 10, rigid member 24 may be made of stainless steel of between 0.055 and 0.075 inches (1.4 and 1.9 mm). Cover 26 may be polyurethane, nitrile rubber, ethylene/propylene rubber, or neoprene have a hardness between 20 and 50 Shore A, preferably 30 Shore A. A thickness of cover 26 at the center being between 0.225 and 0.375 inches (0.57 and 0.95 mm), and a thickness at the ends (which support the knurls) being between 0.040 and 0.060 inches (0.10 and 0.15 mm).

An inexpensive core of the kind illustrated in FIG. 2 may have rigid member 24 made of cardboard or resin reinforced paper, and cover 26 being made of a foam including polystyrene or polyurethane between 0.225 and 0.375 inches (0.57 and 0.95 mm) and having a hardness between 20 and 50 Shore A, preferably 30 Shore A. End members 18,20 may be made of polyurethane with a hardness between 55 and 80 Shore D, preferably 75 Shore D. To reduce cost, end members 18,20 may be press fit to center member 16.

One configuration suitable for reduced cost applications include the selection of high density micro cellular polyurethane (for example, PORON, a trademark of Rogers Corporation) having a thickness between 0.032 and 0.125 inches (0.08 and 0.32 mm), a density between 15 and 30 pounds per cubic foot, and a durometer between 12 and 70 Shore O. Another suitable configuration includes the selection of closed cell, cross-linked polyethylene vinyl acetate copolymer (for example, VOLARA, a trademark of Voltek Division of Sekisui America Corporation), having a thickness between 0.032 and 0.063 inches (0.08 and 0.16 mm), a density between 2 and 6 pounds per cubic foot, and a durometer between 4 and 20 Shore AA.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

PARTS LIST

10 core
12 web
14 knurls
16 central member
18 first end member
20 second end member
22 securing means
24 brigid cylindrical member
26 deformable cover
27 annular shoulder
28 attachment means
30 rigid member
32 outer cover
34 taper
36 keyway
38 end rings
40 keys
42 slots
44,46 ends of cover 26

What is claimed is:

1. A core for winding a web of deformable material thereon, the web having margins and an area disposed intermediate the margins, the margins having a thickness greater than a thickness of the intermediate area, the core comprising:

a rigid cylindrical member extending from a first end to a second end; and a deformable cover having a first hardness and an outer diameter, said cover extending from said first end to said second end and being supported by said rigid member, a portion of said cover supported at said first and second ends being treated by a process to harden said first and second ends to provide said first and second ends with a second hardness harder than said first hardness, the web material being wound on the core such that the margins of the web overlay the hardened ends of said cover.

2. A core for winding a web of deformable material thereon, the web having margins and an area disposed intermediate the margins, the margins having a thickness greater than a thickness of the intermediate area, the core comprising:

a rigid member having a first and second end and a first, second and center portion, said first portion located at one end and said second portion located at the other end, said center portion positioned intermediate said first and second portions, said center portion being cylindrical and having a first diameter, each of said first and second portions including an outwardly directed taper from said center portion toward said first and second end, respectively, defining a conical surface; and a deformable cover having an outer diameter extending from said first end to said second end and supported by said rigid member, the web material being wound on the core such that the margins of the web overlay said first and second portions.

* * * * *